US008701698B2

(12) United States Patent
Möllers et al.

(10) Patent No.: US 8,701,698 B2
(45) Date of Patent: Apr. 22, 2014

(54) DEVICE CONSISTING OF CONTAINERS ATTACHED TO A PALLET FOR TRANSPORTING HAZARDOUS MATERIALS

(75) Inventors: Martin Möllers, Günzburg (DE); Olaf Tietze, Ichenhausen (DE); Friedrich Schnell, Kötz (DE); Philippe Maj, Brignais (FR)

(73) Assignee: Arkema France, Colombes (FR)

( * ) Notice: Subject to any disclaimer, the term of this patent is extended or adjusted under 35 U.S.C. 154(b) by 98 days.

(21) Appl. No.: 13/522,759

(22) PCT Filed: Jan. 25, 2011

(86) PCT No.: PCT/FR2011/050141

§ 371 (c)(1),
(2), (4) Date: Sep. 4, 2012

(87) PCT Pub. No.: WO2011/092424

PCT Pub. Date: Aug. 4, 2011

(65) Prior Publication Data

US 2012/0325352 A1 Dec. 27, 2012

(30) Foreign Application Priority Data

Jan. 28, 2010 (FR) ..... 10 50595

(51) Int. Cl.
*F17D 1/00* (2006.01)

(52) U.S. Cl.
USPC ..... 137/266; 137/263

(58) Field of Classification Search
USPC ..... 137/266, 263, 255, 259, 587, 144
See application file for complete search history.

(56) References Cited

U.S. PATENT DOCUMENTS

| | | | | | |
|---|---|---|---|---|---|
| 2,352,627 | A | * | 7/1944 | Grant, Jr. | 137/255 |
| 2,412,613 | A | * | 12/1946 | Grant, Jr. | 137/255 |
| 3,015,419 | A | * | 1/1962 | Arnett et al. | 222/130 |
| 3,409,175 | A | * | 11/1968 | Byrne | 222/640 |
| 3,976,227 | A | | 8/1976 | Ray | |
| 4,356,937 | A | * | 11/1982 | Simon et al. | 222/129.2 |
| 4,842,245 | A | | 6/1989 | Kelsey | |

(Continued)

FOREIGN PATENT DOCUMENTS

| | | | |
|---|---|---|---|
| DE | 2611925 | A1 | 9/1977 |
| DE | 8236728 | U1 | 4/1983 |
| EP | 0308554 | A1 | 3/1989 |
| WO | WO 02/064454 | A2 | 8/2002 |

OTHER PUBLICATIONS

*International Search Report (PCT/ISA/210) issued on May 19, 2011, by the European Patent Office as the International Searching Authority for International Application No. PCT/FR2011/050141.

*Primary Examiner* — John Rivell
*Assistant Examiner* — Umashankar Venkatesan
(74) *Attorney, Agent, or Firm* — Buchanan Ingersoll & Rooney P.C.

(57) ABSTRACT

The field of transporting hazardous materials and specifically to a pallet that holds containers for receiving a liquid, for example an organic peroxide, which, for safety reasons, can only be transported in small amounts. A device that includes 2 to 20, and preferably 2 to 10, containers attached onto a pallet, said containers being intended to contain a hazardous material in liquid form, the containers all having a volume greater than 100 L and preferably between 120 to 300 L.

15 Claims, 2 Drawing Sheets

(56) References Cited

U.S. PATENT DOCUMENTS

| | | | | |
|---|---|---|---|---|
| 5,615,702 | A * | 4/1997 | Dawans et al. | 137/255 |
| 6,196,255 | B1 * | 3/2001 | Poillucci | 137/266 |
| 6,418,961 | B1 * | 7/2002 | Edstrom, Sr. | 137/259 |
| 6,708,573 | B1 * | 3/2004 | Cohen et al. | 73/865 |
| 6,786,245 | B1 * | 9/2004 | Eichelberger et al. | 141/4 |
| 7,178,565 | B2 * | 2/2007 | Eichelberger et al. | 141/47 |
| 8,156,970 | B2 * | 4/2012 | Farese et al. | 141/94 |
| 2004/0112439 | A1 | 6/2004 | Eisenhut et al. | |
| 2007/0209708 | A1 * | 9/2007 | Hermann et al. | 137/255 |

* cited by examiner

DEVICE CONSISTING OF CONTAINERS ATTACHED TO A PALLET FOR TRANSPORTING HAZARDOUS MATERIALS

The invention concerns the field of the transportation of hazardous materials, and more particularly a pallet that supports containers intended to receive a liquid, for example an organic peroxide, which can be transported only in small quantities for safety reasons.

Organic peroxides are hazardous materials causing risks when they are transported, stored and used, which peroxides can lead to a discharge in the event of impact or at high temperature. On discharge, such a great quantity of heat can be released that in the case of too powerful an impact or blow or an increase in temperature a major explosion may be produced. This has led to the transportation and storing of these organic peroxides being subject to strict safety provisions.

To control these risks specific rules have therefore been developed by international bodies. The recommendations relating to the transportation of hazardous materials published by the United Nations represent a solid basis for various national and international regulations.

To limit costly and risky manipulation, the aim is to transport these products in packaging as large as possible provided with the necessary safety equipment. The revised 15th edition of the recommendations relating to the transport of hazardous merchandise published in 2007 defines in sections 4.1.7.2.4 and 4.2.1.13.8 test principles for determining the dimensions of the venting devices necessary for the safe transportation of organic peroxides in "large bulk containers" or in tanks. As a general rule, packaging in individual containers of the order of 1000 liters or more entails diluting the products to a concentration such that the formulation satisfies the vent dimension criteria.

Various ways have been found to use products of higher concentration than the limit concentration for vents that can be produced in the packaging concerned.

The patent EP0308554B1 describes the use of dip tubes connected to a vent situated towards the bottom of the container that in the event of a rise in pressure in the container enables opening of the vent and preferably emptying of the liquid to the exterior, thus protecting the container from too high a pressure.

However, inappropriate activation of the vent, for example because of fatigue of the materials, may lead to a hazardous discharge of product to the exterior. Moreover the volume of the large-diameter dip tube leads to a marked lack of homogeneity at the time of filling or emptying the container.

The patent application WO02064454 describes the transportation of a concentrated peroxide solution connected to a tank of phlegmatizing agent ready to be mixed in the event of danger to obtain a more dilute solution representing a lesser danger.

The patent application DE8236728 shows how a plurality of containers of small capacity, less than 100 liters and preferably from 20 to 30 liters, may be assembled on a pallet to enable common filling with and emptying of hazardous materials. The disadvantage of these small containers is that a large number of relatively small containers must be available both where the organic peroxides are produced and where they are consumed. Moreover, a non-negligible quantity of peroxides may remain trapped in the manifold after the operations of filling or emptying hazardous materials, because of the arrangement of the valves, disposed both upstream and downstream of the manifold. This represents a risk in transportation in particular, peroxides trapped in the manifold being unable to flow through a vent in the event of an impact or rise in temperature. The volume of the manifold thus has a very strong impact on the safety of the pallet.

Thus there still exists a requirement to transport large quantities of hazardous materials at one and the same time, under good safety conditions, thus enabling the number of manipulations linked to the transportation of these products to be limited.

Although the person skilled in the art competent in the field of preparation, application and use of organic peroxides has known for a number of years of the problems and disadvantages of known pallets with a plurality of containers for liquids containing peroxide, this has not led to modification of the known pallets prior to the present invention. It is clear that making modifications to the existing situation was not obvious to the person skilled in the art. It is assumed that the person skilled in the art did not dare to depart from the strict safety provisions drawn up with great care and based on several years of practical experience. In other words, there was a prejudice that prevented the person skilled in the art from moving away from the existing situation. Surprisingly, what the invention proposes eliminates the disadvantages of the known pallets and at the same time improves safety because these strict safety provisions can in practice be adhered to even better.

The invention provides a device comprising 2 to 20 and preferably 2 to 10 containers fixed on a pallet, said containers being designed to contain a hazardous material in liquid form, the containers all having a volume greater than 100 liters and preferably from 120 to 300 liters, characterized in that said device comprises:

- a common manifold equipped with a number of inlets that corresponds to the number of containers and a common outlet equipped with a common valve, the inlets of the manifold being coupled to the outlets of the containers; and
- a valve disposed on one or more inlets between the containers and the manifold, it being understood that one of the inlets is not equipped with a valve.

The pallet of the invention, which constitutes an independent transportation unit, contains from 2 to 20 and preferably from 2 to 10 containers fixed to said pallet, said containers being suitable for the transportation of hazardous materials.

Accordingly, said containers preferably contain one or more liquid organic peroxides, in solution or suspension form, optionally diluted in a solvent. The organic peroxide may be chosen, for example, from diacyl peroxides, peroxyesters, peroxydicarbonates, perketals, and mono-peroxycarbonates.

The containers all have a volume of at least 100 liters, and preferably from 150 to 200 liters. The containers all have their own outlet which is constituted of a common manifold having a number of inlets that corresponds to the number of containers and a common outlet, the inlets of the manifold being coupled to the outlets of the containers. The containers are preferably all equipped with a vent.

An advantageous embodiment of the pallet of the invention is characterized in that a valve, preferably a remote-controlled valve, is disposed on each container. These valves will advantageously be configured so that each valve opens when emptying or filling the containers.

Each container may also be provided with a supplementary opening enabling for example during emptying of the containers introduction of air or a protective gas into the containers, although this function can be fulfilled by the valves referred to above.

In one advantageous embodiment, a single valve controls the simultaneous opening and closing of a plurality of inlets.

The common outlet of the manifold may be connected to a device at the point of use, i.e. on the premises of the producer, where the common outlet of the manifold will be used to fill the containers, and on the premises of the consumer, where the common outlet of the manifold will be used to empty the containers.

By means of this manifold, a large number of containers may be emptied continuously or discontinuously, simultaneously or successively.

This avoids manipulations requiring considerable labour and improves safety. Above all on the premises of large consumers of peroxide, the pallet of the invention enables economies of scale to be achieved, at the same time as reducing the risk of accidents.

Thus with the pallet of the invention safety provisions may be complied with better, even in enterprises where the personnel is relatively untrained.

The containers placed on the loading surface of the pallet are preferably fixed, i.e. mechanically connected to the pallet by mechanical attachments or belts, or thanks to a particular structure of the pallet perfectly matching the shape of the containers.

The pallet of the invention may be refilled via the manifold after being emptied. During filling, the inlets become inlets for the flow of peroxides and during emptying the inlets become outlets for the flow of peroxides.

The manifold is defined as the space formed between the valves equipping each inlet, on the one hand, and the common filling or emptying valve, on the other hand.

The inlets and the manifold are preferably made from stainless steel or a synthetic material, in particular polyethylene or polyfluorinated hydrocarbons, for example polytetrafluoroethylene.

The particular disposition of the valves on the device of the invention, i.e. the fact that one and only one inlet is not equipped with opening and closing valves, makes it possible to prevent even a minimum quantity of organic peroxide from remaining trapped in the manifold. In other words, a quantity of peroxide remaining in the manifold, for example after filling or emptying operations, will always be connected directly to a container and preferably to the vent or to the valve disposed on that of the containers equipped with the inlet with no valve.

Accordingly, in contrast to known devices, the volume of the manifold has no impact on the safety of the pallet.

A remote-controlled metering pump and/or a valve, for example a remote-controlled valve, may be fitted to the common outlet of the manifold, downstream of the common valve. This equipment may be in any order, i.e. common valve/valve/metering pump/free outlet or common valve/metering pump/valve/free outlet.

The free end of the manifold or where applicable the side of the valve or the metering pump not facing towards the manifold will advantageously be configured to enable secure and fast connection to a reactor on the premises of the consumer or on the premises of the producer of the organic peroxide.

In a preferred embodiment of the pallet of the invention the inlets are coupled to the outlets of the containers via tubes that extend right to the bottom of the containers so as to be able to empty the containers completely.

The pallet of the invention is advantageously configured in the form of a transportable pallet, either fixed, in which case it will be equipped with feet, or mobile, in which case it contains from 2 to 20 and preferably 4 containers disposed on a loading surface of the pallet. To this end, feet or wheels are preferably disposed on the underside of the pallet. According to the invention, this pallet may have two or more loading surfaces disposed one above the other(s), at least 4 and preferably 8 containers designed to receive one or more organic peroxides being disposed on each loading surface. For safety reasons, a protective grille may be disposed at the periphery of the pallet, for example in the form of a wire mesh or a cage.

The pallet of one preferred embodiment of the invention is characterized in that control members are provided enabling remote operation of the pumps and valves from a switching desk situated externally of the pallet. Safety and reliability may be increased if there is installed on the pallet a signalling device which, when all the containers coupled to the manifold have been emptied, transmits a signal indicating disconnection of the metering pump and closing of the valves.

The pallet of the invention is particularly suitable in practice for all processes that use large quantities of hazardous materials, in particular organic peroxides.

Furthermore, the pallet of the invention is perfectly suitable for use in automated chemical reaction processes, for example for the synthesis of polymers such as polyvinyl chloride, polystyrene or polyethylene, as well as for the continuous fabrication of plates, tubes and tanks and, for example, the synthesis of synthetic marble in polyester resin.

When the pallet of the invention is used, it is connected to the device with which the fabrication and chemical reaction operation referred to above is carried out. Inserting connecting parts for coupling the common outlet of the manifold to this device is nevertheless envisaged in the context of the invention.

It is advantageous for the connecting parts provided between the containers and the manifold to be substantially the same length. Automation of said processes can in practice be achieved only with the pallet of the invention. In particular, when the pallet is used in accordance with the invention, less disturbance to the production process is observed, which is favourable for the quality of the end product. The strict safety provisions do not in practice constitute an impediment, and may even be complied with better.

The invention will now be described in more detail with the aid of the appended three figures.

Figure 1:
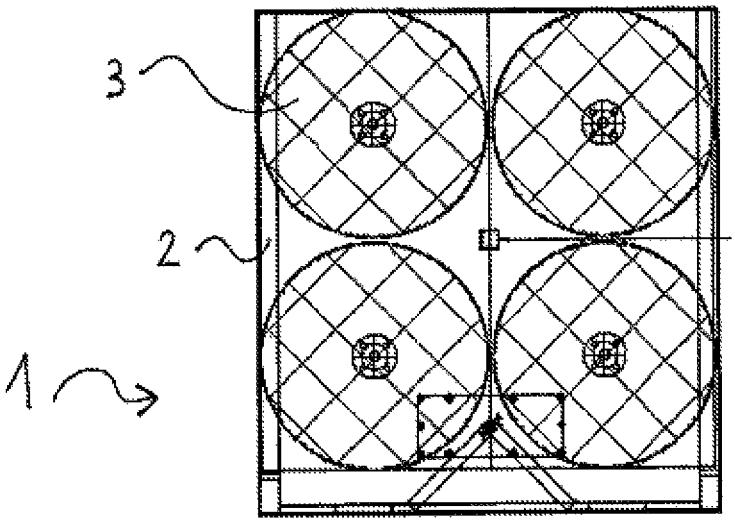
FIG. 1 represents a plan view of the pallet of the invention.
Figure 2:
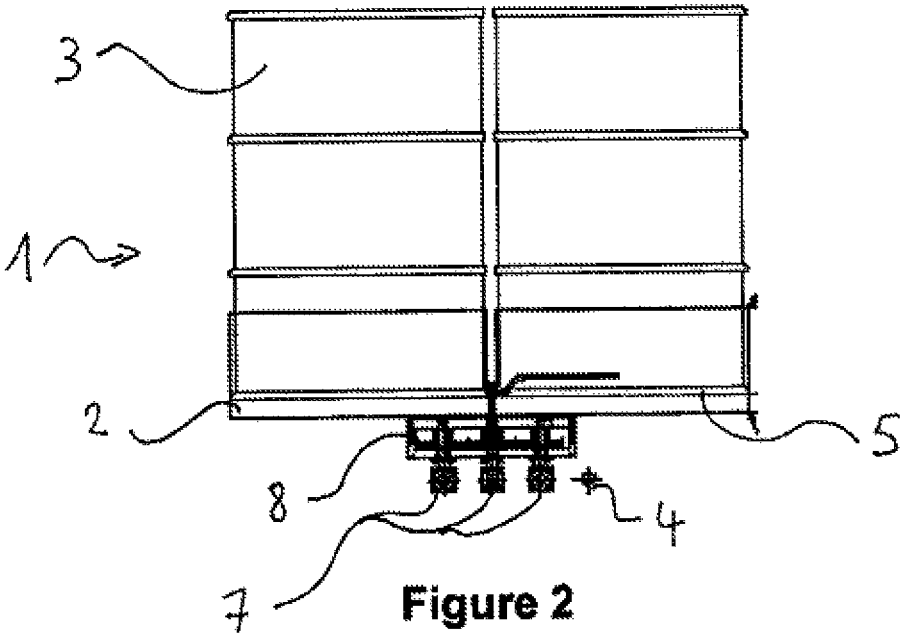
FIG. 2 represents a lateral view of the pallet of the invention.

In FIGS. 1 and 2, the pallet 2 includes containers 3 made from a synthetic material and which may all be filled for example with 100 to 500 kg of a liquid that contains one or more organic peroxides. The figures indicate only the more important parts of the pallet so as not to overcomplicate the drawing. The four containers are disposed on the loading surface (FIG. 2) and fixed in a manner that is not represented. Each container is provided with a closed cap on which are disposed in addition to the inlet 4, possibly a vent, a valve and another outlet enabling the admission of protective gas. The inlets 4 are disposed on the upper part of the containers 3 (FIG. 3) and may be configured as tubes that extend down into the containers as far as their bottom 5. These tubes may be provided at the bottom of the containers 3 with a check valve. The valve must be connected so as to close as soon as the container is empty, to prevent the aspiration of air. The common outlet 6 may terminate at a lower location on the loading surface 5, so that the containers 3 can be emptied completely. The valves 7 equipping the inlets 4 may be configured as magnetic valves operated or controlled remotely and/or automatically from a switching desk.

Figure 3:
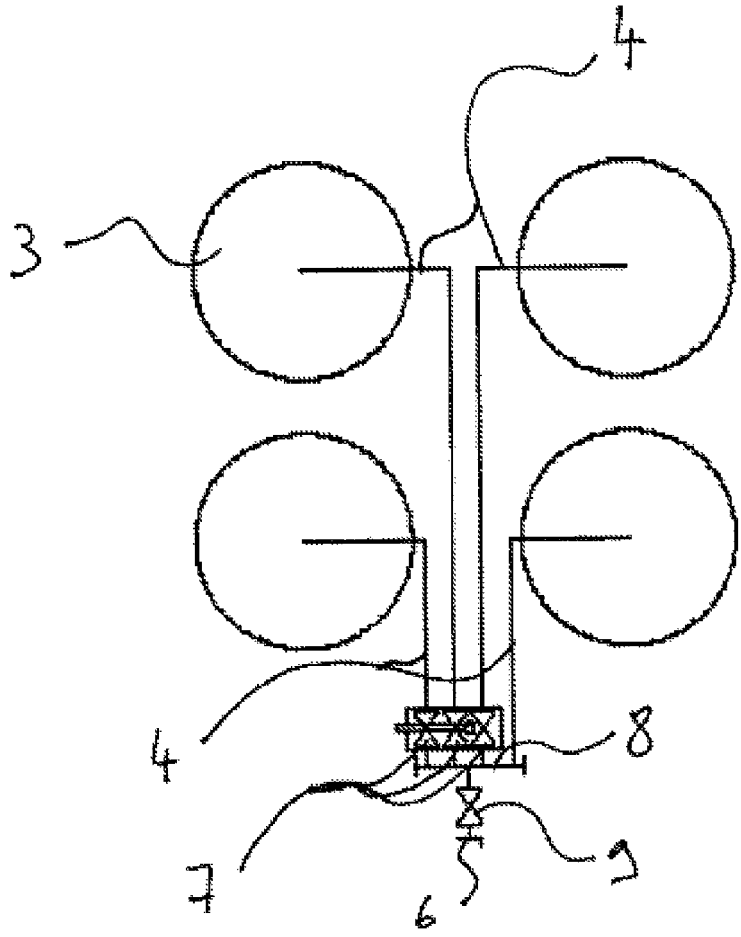
FIG. 3 represents a diagrammatic view of the pallet of the invention in which the inlets, outlets and valves appear.

As may be seen in FIG. 3, one of the inlets (4) is not equipped with a valve (7), the liquids stored in that of the containers equipped with an inlet without valves being directly in contact with the common valve 9 via the manifold 8.

Accordingly, as specified above, a quantity of liquid remaining in the manifold after filling or emptying operations, for example, will always be connected directly to the vent disposed on that of the containers equipped with the inlet with no valve. Accordingly, in contrast to known devices, the volume of the manifold has no impact on the safety of the pallet.

A metering pump made from stainless steel or synthetic material may be connected to the common outlet 6 of the manifold 8, the free end of the metering pump, or more generally of the common outlet 8, or of the common valve 9, being equipped with a quick-connect device. The quick-connect device may itself be connected to a reactor, for example a polymerization reactor, to which the organic peroxides must be added so that they fulfil their function, i.e. enable polymerization. The common outlet 6, the common valve 9 and the quick connector may also be operated automatically and/or remotely via control lines.

To enable uniform, simultaneous and complete emptying of all the containers 3, all the inlets 4 are substantially the same length.

When the pallet 2 that contains containers 3 that are full has been connected to a reactor via the common outlet 6, the containers 3 may be emptied simultaneously or separately, continuously or discontinuously, as a function of the requirement for peroxide in the reactor. When the containers 3 have been emptied, they may remain in place on the loading surface 5, which enables two important advantages to be achieved. The first advantage is a considerable saving in laborious manual work needing physical force. The second advantage, which is more important, is improved safety and better compliance with safety provisions, even with personnel with relatively little chemical training.

Although there has always been referred to above emptying full containers 3 into the reactor and the advantages that the pallet of the invention enables to be achieved, comparable advantages are achieved during the operation of filling the containers 3 in which the peroxides are prepared. During filling, the flow in the manifold 8, the common outlet 6 and the inlets 4 may be in the opposite direction. However, any check valves present at the end of the inlets, at the bottom of the containers must then be switched out of service by appropriate switching means.

Modifications of different kinds may be made without departing from the scope of the invention. In particular, there may also be fixed to the pallet groups of more than 4 containers, for example 6, 8, 10, 12, 14, 16 containers, etc. Although in the embodiments represented the liquid is extracted from the containers in the upward direction, it is naturally also possible to extract the liquid from the containers via a pipe that passes through the bottom of the containers 3.

Moreover, any connecting parts provided between the inlets of the manifold and the containers themselves not only have similar lengths but also similar volumes and a flow resistance of the same order. Although the pallet loaded with containers may be placed in the close proximity of the reactor, for example at a distance from one meter up to a few meters, it is equally possible to place the pallet at a greater distance from the reactor.

The invention claimed is:

1. Device comprising 2 to 20 containers fixed on a pallet, said containers being designed to contain a hazardous material in liquid form, the containers all having a volume greater than 100 liters, wherein said device comprises:

a common manifold equipped with a number of inlets that corresponds to the number of containers and a common outlet equipped with a common valve, the inlets of the manifold being coupled to the outlets of the containers, a valve disposed on one or more inlets between the containers and the manifold, wherein one of the inlets is not equipped with a valve.

2. Device according to claim 1, wherein a single valve controls the simultaneous opening and closing of a plurality of inlets.

3. Device according to claim 1, wherein the manifold is made from stainless steel or synthetic material.

4. Device according to claim 1, wherein a metering pump is coupled to the common outlet of the manifold.

5. Device according claim 1, wherein the containers are equipped with a vent.

6. Device according to claim 1, wherein the inlets are coupled to the outlets of the containers by tubes that extend downwardly in the containers as far as their bottom.

7. Device according to claim 1, wherein wheels are disposed on the underside of the pallet.

8. Device according to claim 1, the device further comprising at least two loading surfaces disposed one above the other, at least 4 containers being disposed on each loading surface.

9. Device according to claim 1, wherein a protective grille is disposed at the exterior periphery of the pallet.

10. Device according to claim 1, wherein the containers contain at least one organic peroxide chosen from diacyl peroxides, peroxyesters, peroxydicarbonates, perketals, and mono-peroxycarbonates.

11. Device according to claim 1, wherein the device has 2 to 10 containers fixed on the pallet.

12. Device according to claim 1, wherein the containers all having a volume from 120 to 300 liters.

13. Device according to claim 3, wherein the manifold is made from polyethylene or a polyfluorinated hydrocarbon.

14. Device according to claim 13, wherein the manifold is made from polytetrafluoroethylene.

15. Device according to claim 8, wherein at least 8 containers are disposed on each loading surface.

* * * * *